US008646995B2

(12) United States Patent
Furuyama

(10) Patent No.: US 8,646,995 B2
(45) Date of Patent: Feb. 11, 2014

(54) IMAGE RECORDING APPARATUS

(75) Inventor: Koji Furuyama, Fukushima (JP)

(73) Assignee: Oki Data Corporation, Tokyo (JP)

( * ) Notice: Subject to any disclaimer, the term of this patent is extended or adjusted under 35 U.S.C. 154(b) by 1112 days.

(21) Appl. No.: 12/039,761

(22) Filed: Feb. 29, 2008

(65) Prior Publication Data

US 2008/0240825 A1 Oct. 2, 2008

(30) Foreign Application Priority Data

Mar. 27, 2007 (JP) ..... 2007-082021

(51) Int. Cl.
*B41J 25/304* (2006.01)

(52) U.S. Cl.
USPC ..... 400/56; 347/8

(58) Field of Classification Search
USPC ..... 400/56
See application file for complete search history.

(56) References Cited

U.S. PATENT DOCUMENTS 3,750,792 A * 8/1973 Liles ..... 400/56
3,904,010 A * 9/1975 Krauss et al. ..... 400/56
3,935,936 A * 2/1976 Wilczewski ..... 400/55
4,151,397 A * 4/1979 Boor et al. ..... 400/120.17
4,420,269 A * 12/1983 Ackermann et al. ..... 400/56
4,774,529 A * 9/1988 Paranjpe et al. ..... 400/82
5,000,590 A * 3/1991 Einem ..... 400/55
6,637,958 B2 * 10/2003 Smith ..... 400/55
6,736,557 B2 * 5/2004 DeVore et al. ..... 400/56
7,014,293 B2 * 3/2006 Ikeda et al. ..... 347/37

FOREIGN PATENT DOCUMENTS

JP 2542947 Y2 4/1997

* cited by examiner

*Primary Examiner* — Jill Culler
(74) *Attorney, Agent, or Firm* — Panitch Schwarze Belisario & Nadel LLP

(57) ABSTRACT

The present invention supplied an excellent printer which can print on a thick print medium without deformation of character. In the printer, a tension spring is respectively furnished on both ends of a carriage shaft which slidably supports a carriage carrying a print head, and pulls the carriage shaft upward; a carriage shaft gear is respectively fixed the both ends of the carriage shaft and engages with rack furnished on a side frame; the carriage shaft only moves up and down; and when a print medium P whose thickness is a predetermined thickness or over is fed, the carriage does not incline, but evenly moves upward through rotation of the carriage shaft gear.

21 Claims, 10 Drawing Sheets

IMAGE RECORDING APPARATUS

BACKGROUND OF THE INVENTION

1. Field of the Invention

The invention relates to an image recording apparatus such as printer which performs a print on mediums such as bank book and the like with different thicknesses; in particular, printer which keeps a fixed interval between print head and medium according to the different thicknesses of the mediums.

2. Related Background Art

In previous printer, in order to keep an interval between print head and print medium in a fixed value, an automatic paper thickness judgment mechanism was provided. The automatic paper thickness judgment mechanism has a guide plate fixed on a carriage as contacting with surface of the print medium. According to a self weight of the print head, the guide plate presses the print medium. When a thicker print medium is fed, the guide plate rises due to thickness of the print medium, thus a fixed interval is set between surface of the print medium and front edge portion of the print head. The printer provided with the automatic paper thickness judgment mechanism has been disclosed in Japan utility model publication No. 2542947 and etc.

Patent document 1: Japan utility model publication No. 2542947.

However, in the printer disclosed in the patent document 1, the carriage carrying the print head can rotate around a carriage shaft as a center. When a thicker print medium is fed into lower side of the guide plate, the carriage rotates around the carriage shaft and expands an interval with the print medium. Therefore, an angle formed between the front edge portion of the print head and the print medium becomes inclined so as to make printed character and the like deform.

SUMMARY OF THE INVENTION

It is, therefore, an object of the invention to provide an image recording apparatus capable of solving the above problem. That is, it is to supply an excellent image recording apparatus without deformation of the printed character when printing on a thicker print medium.

According to the present invention, there is provided an image recording apparatus for performing a print on medium opposite to a print head through the print head, comprising a carriage that carries the print head and is movably fit on a carriage shaft, wherein the carriage shaft is furnished so that the print head can move along a slight orthogonal direction with respect to an opposite surface opposite to the medium; a guide means is provided to guide the carriage shaft to move along the slight orthogonal direction; and the carriage shaft and the carriage are guided by the guide means to move along the slight orthogonal direction according to a thickness of the medium fed to a position opposite to the print head.

EFFECT OF THE PRESENT INVENTION

According to the present invention with the above stated structure, when a thicker print media is fed to a print position, the carriage and the print head move along a slight orthogonal direction being slightly orthogonal with respect an opposite surface that the print head is opposite to the media. So that the front edge portion of the print head does not incline with respect to the media. As a result, the printed character and the like don't deform.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. In the following embodiments, regarding the same element used in common, the same symbol is assigned.

Embodiment 1

Figure 1:
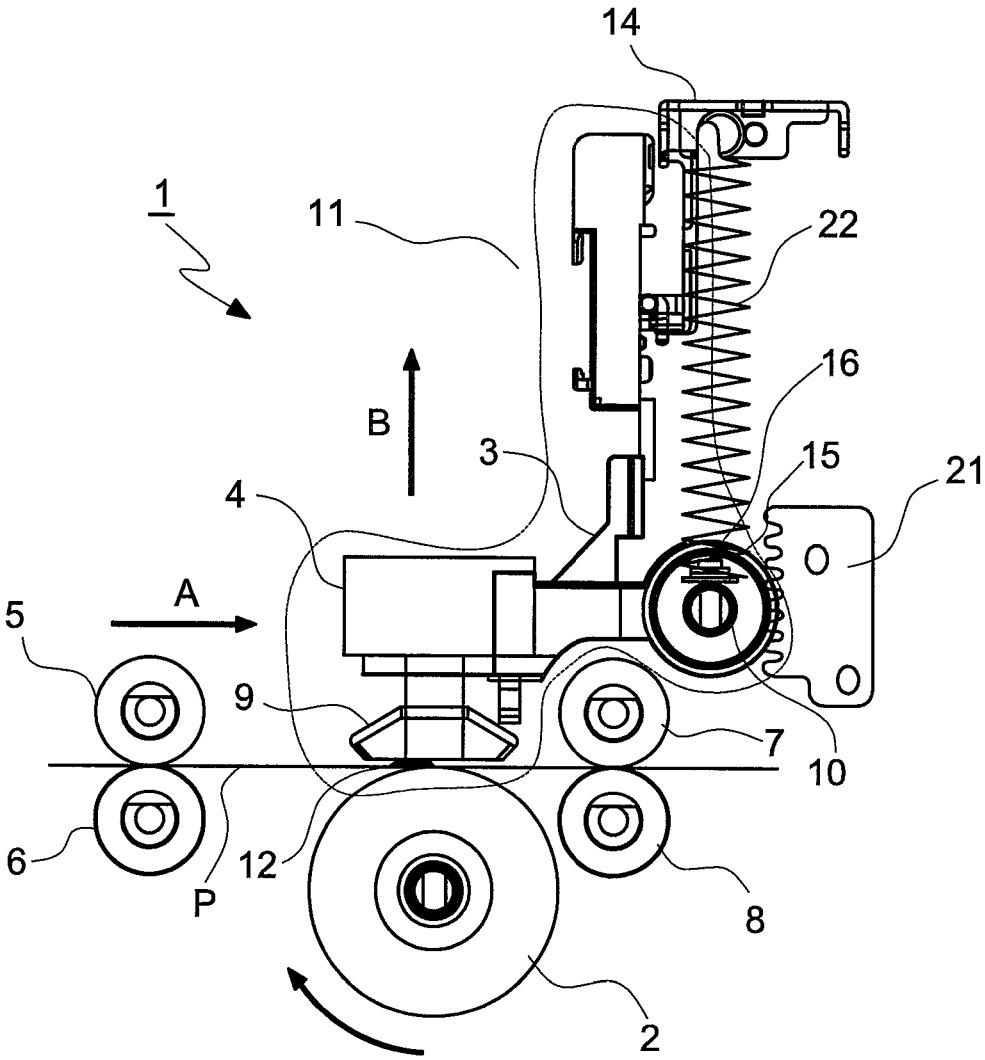
FIG. 1 is a side elevation showing main part of a printer in embodiment 1 of the present invention.
Figure 2:
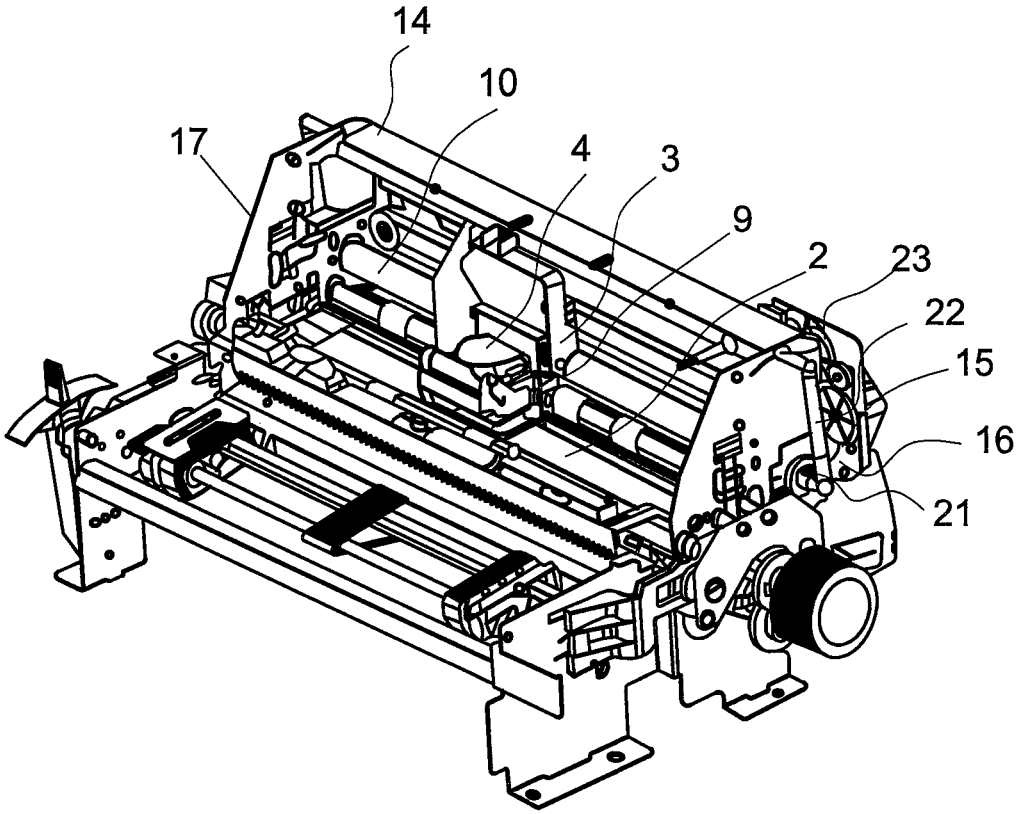
FIG. 2 is an oblique drawing showing a printer in the embodiment 1.

FIG. 1 is a side elevation showing main part of a printer in embodiment 1 of the present invention; and FIG. 2 is an oblique drawing showing a printer in the embodiment 1. An impact printer is explained as an example of the image recording apparatus in all embodiments below.

As shown in FIG. 1 and FIG. 2, a printer 1 in the embodiment 1 comprises a platen 2, a carriage 3, a print head 4, paper feed rollers 5, 6, 7, 8 and a paper guider 9. The platen 2 is formed in a shape of cylinder, rotates along an arrow direction and constructs a print position with front edge portion of the print head 4. The carriage 3 is slidably mounted on a carriage shaft 10 and carries the print head 4. When printing, the carriage 3 moves along the carriage shaft 10 with spacing; and performs a print through the print head 4.

The print head 4 is placed above the platen 2 as facing to the platen 2, moves together with the carriage 3 along the carriage shaft 10, and meanwhile, performs a print on a print medium P. The carriage 3, the print head 4 and the paper guider 9 above mentioned form a carriage assembly 11. The paper feed rollers 5, 6, 7 and 8 are used to feed the print medium P and are furnished both sides of the print position.

Figure 3:
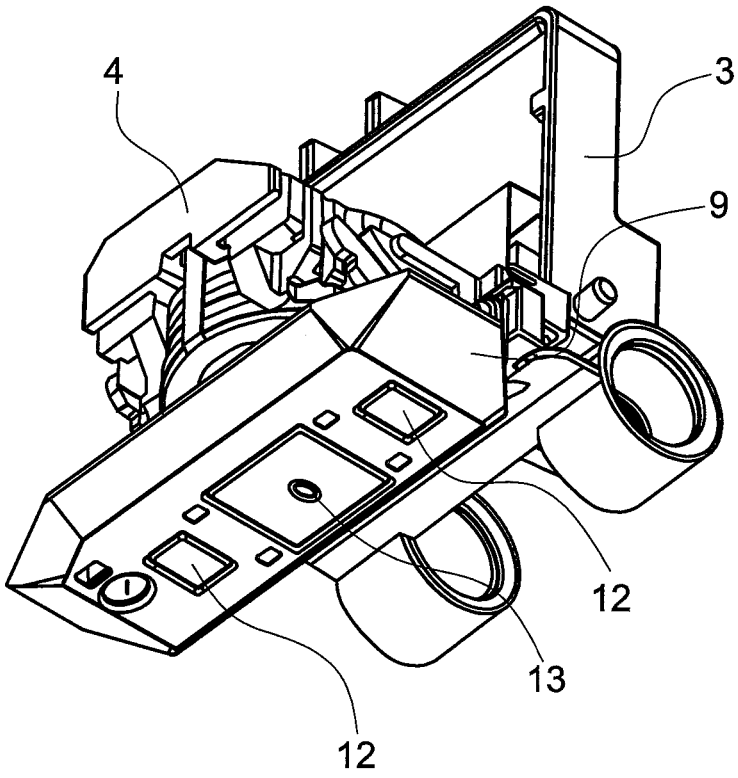
FIG. 3 is an oblique drawing showing a carriage assembly.

FIG. 3 is an oblique drawing showing a carriage assembly.

The paper guider 9 is furnished on the front edge portion of the print head 4, as shown in FIG. 3, and a guide block 12 is furnished on an inner side (on the side of platen 2). That is, the guide block 12 is furnished on both sides of a print hole 13 of the paper guider 9, and is made from, for example, ceramic.

The guide block 12 is furnished so as to downwards protrude only a predetermined distance and to space predetermined interval with the platen 2. When the print medium P whose thickness is below a predetermined thickness (e.g. 0.08 mm) is fed to the print position, the guide block 12 does not press the print medium P; but when the print medium P whose thickness is the predetermined thickness or over is fed to the print position, the guide bock presses the print medium P and keeps to contact the print medium P when printing.

Through the guide block 12 contacts the print medium P, in order to set a suitable clearance value between the print medium P and the front edge portion of the print head 4, a position relationship between the print head 4 and the guide block 12 is set.

Figure 4:
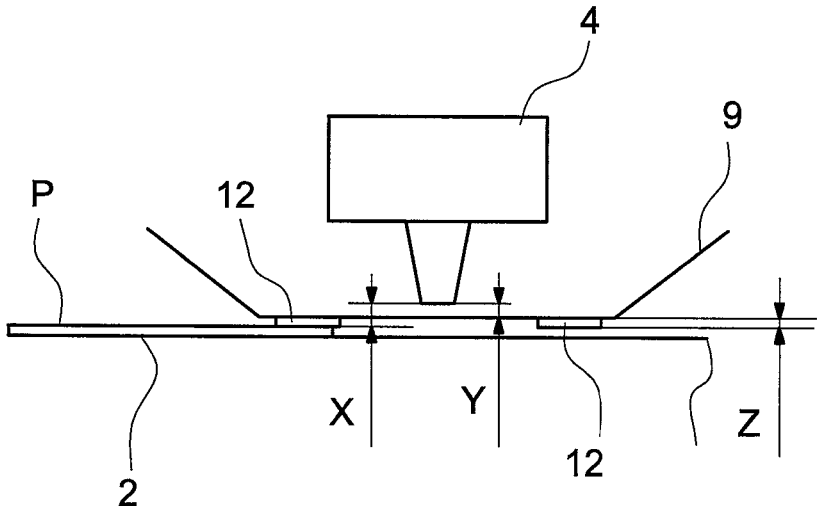
FIG. 4 is a mode chart showing a position relationship between a print head and a guide block.

FIG. 4 is a mode chart showing a position relationship between a print head and a guide block.

As shown in FIG. 4, when the print medium P contacts the guide block 12, a clearance X between the front edge portion of the print head 4 and the print medium P is kept in a value obtained by adding a thickness (Z mm) of the guide block 12 to a distance (Y mm) from the front edge portion of the print head 4 to the paper guider 9.

Next is to return to FIG. 1 and FIG. 2 to continue explanation. The carriage shaft 10 is furnished on the slant upside of the platen 2, i.e. is furnished on the downstream side of a conveyance direction (arrow A direction) of the print medium P with respect to the platen 2 and extends along an orthogonal direction with respect to the conveyance direction of the print medium P (i.e. the direction at right angles to a plan of the drawing paper). As stated above, the carriage 3 is slidably supported by the carriage shaft 10 and shuttles along the carriage shaft 10.

The upper portion of the carriage 3 is a slide portion, and can move under a guidance of the guide rail 14 furnished on a frame of the apparatus. A clearance is spaced between the upper portion of the carriage 3 and the guide rail 14, the carriage 3 can move upward.

The carriage shaft gears 15 is furnished on both ends of the carriage shaft 10, and are respectively fixed by a bolt 16. The carriage shaft 10 can rotate and can move along an up and down direction; and it is supported by a side frame 17 in FIG. 2.

Figure 5:
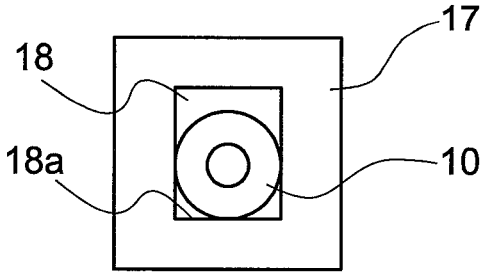
FIG. 5 is an explanatory drawing showing a carriage shaft and a side frame.

FIG. 5 is an explanatory drawing showing a carriage shaft and a side frame.

As shown in FIG. 5, a rectangular guide hole 18 is formed on the side frame 17, and the carriage shaft 10 is fit in the guide hole 18.

The width of the guide 18 is nearly equal to the diameter of the carriage shaft 10. Though the carriage shaft 10 can not move transversely, because the height of the guide hole 18 is set into that larger that diameter of the carriage shaft 10, so the carriage shaft 10 can move up and down. In the case to wait for a print or to print on the print medium P with a thickness lower than the predetermined thickness (e.g. 0.08 mm), the carriage shaft 10 locates at a position contacting a lower part 18*a* of the guide hole 18. The respective guide holes 18 are arranged on right and left sides of the side frame 17.

Figure 6:
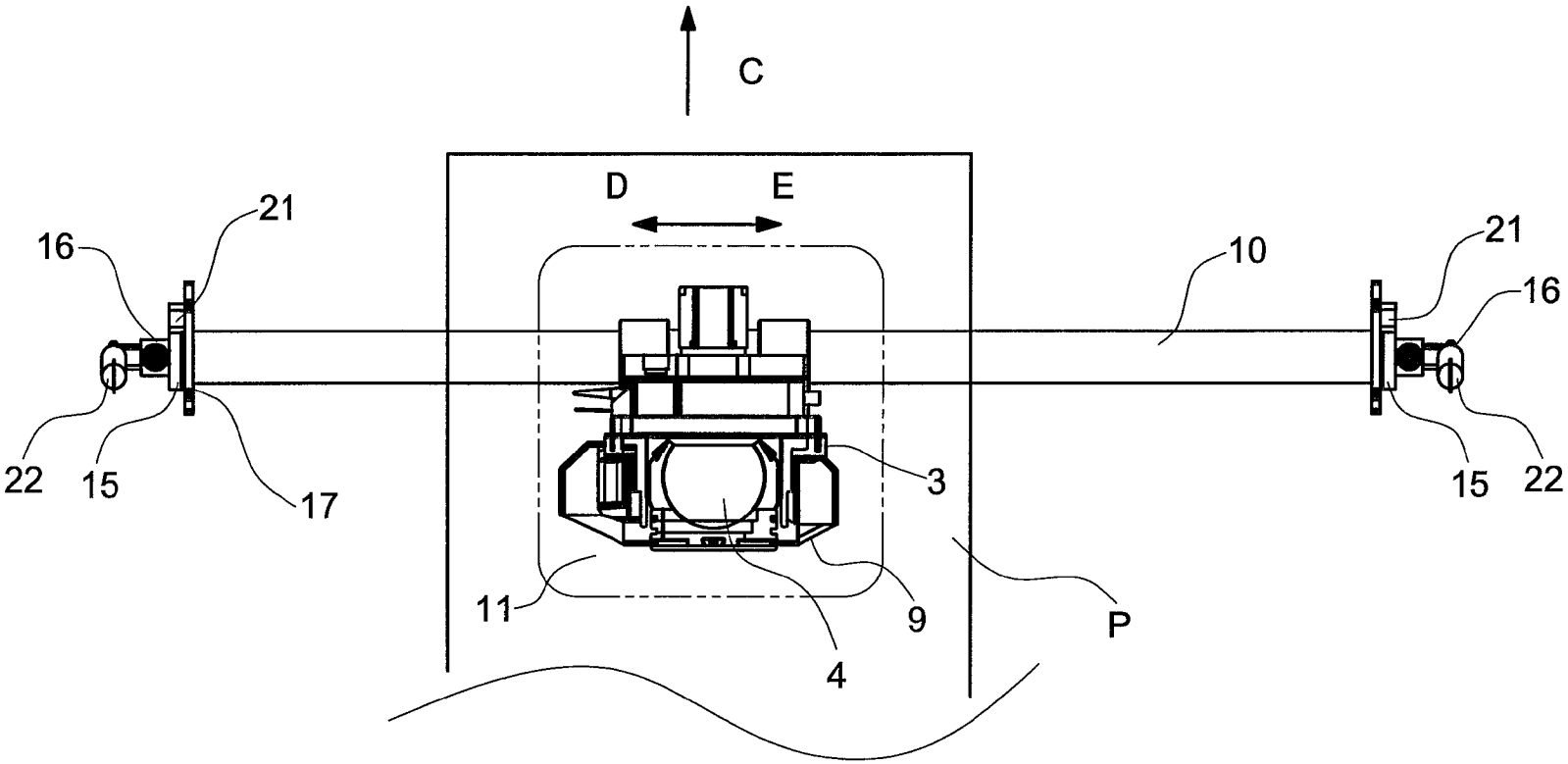
FIG. 6 is a plan drawing showing a carriage and a carriage shaft.

FIG. 6 is a plan drawing showing a carriage and a carriage shaft.

As shown in FIG. 6, a mounting position of the carriage shaft 15 is arranged on external side of the side frame 17. The carriage shaft gear 15 can rotate together with the carriage shaft 10. Further, on the side frame 17, a rack 21 is furnished and the rack 21 engages with the carriage shaft gear 15. In addition, an arrow C direction in FIG. 6 indicates the conveyance direction of the print medium P, and an arrow D-E direction indicates a spacing direction.

Teeth of the rack 21 are formed in an up and down direction. The carriage shaft gear 15 climbs the rack 21 up through self rotation, so the carriage shaft 10 moves upward. Through matching the phases of the carriage shaft gear 15 and the rack 21 that are arranged on left and right of the carriage shaft 10, the carriage shaft 10 can move upward in a parallel state to the platen 2.

Figure 7:
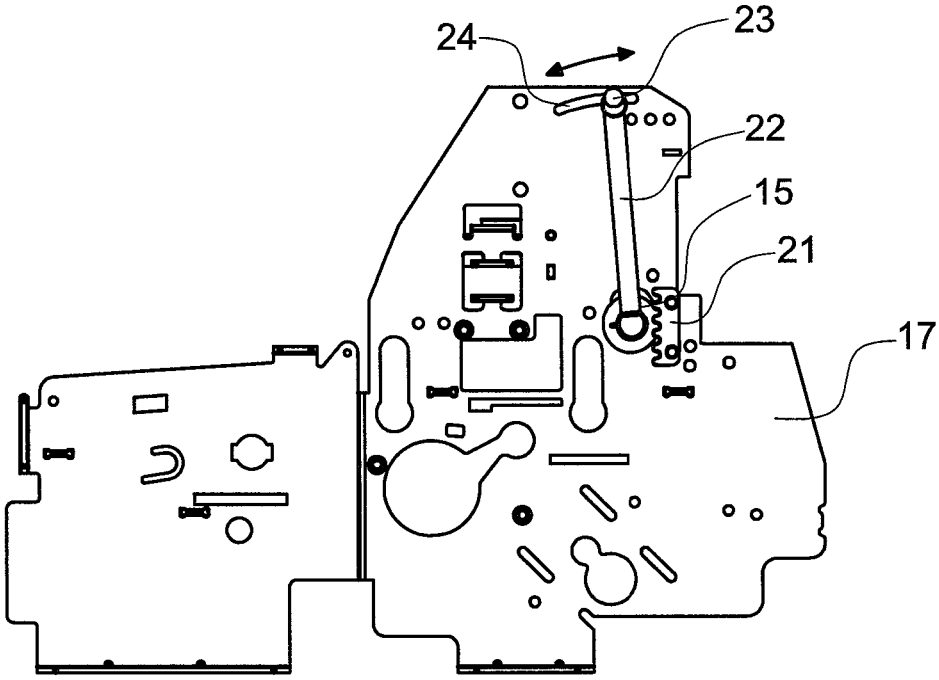
FIG. 7 is a side elevation showing external side of a side frame.

FIG. 7 is a side elevation showing external side of a side frame.

Further, as shown in FIG. 6 and FIG. 7, lower parts of tension springs 22 are respectively tied to both ends of the carriage shaft 10. The upper part of the tension spring 22 is tied to a post 23. The tension spring 22 has a function to pull the carriage shaft 10 upward. The post 23 is movably furnished on a curved hole 24 formed on the upper part of the side frame 17 so as to change inclination angle of the tension spring 22.

On the post 23, a fixing bolt not shown in the drawings is installed so as to fix the post 23 at any position within the curved hole 24. In addition, the movement of the post 23 is manually controlled by an operator. Through pulling up the carriage shaft 10, the tension spring 22 can adjust load of the print head 4 with respect to the print medium P. Through making the tension spring 22 incline to the print head 4, it is possible to control rotation of the carriage 3 caused by reaction force of the impact force of the print head 4 when printing. And moreover, because the inclination angle of the tension spring 22 can be set discretionarily, when the impact force of the print head 4 changed, it is possible to adapt the situation.

Figure 8:
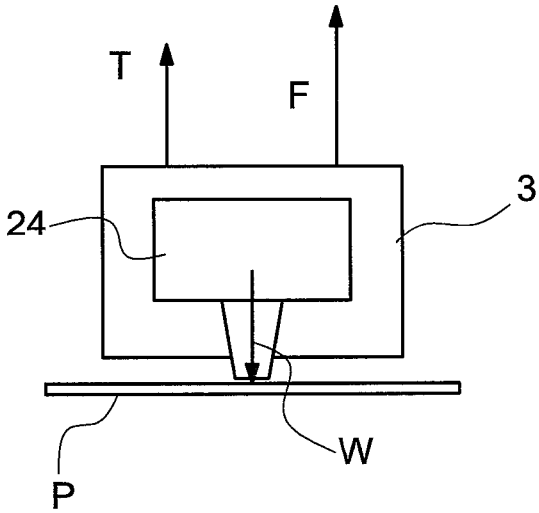
FIG. 8 is an explanatory drawing showing load of print medium.

FIG. 8 is an explanatory drawing showing load of print medium.

As shown in FIG. 8, in the case to set a load given by self weight of the carriage 3 with respect to the print medium P on the platen 2 into W; to set a pulling force of the tension spring 22 into T; and to set a reaction force of impact force of the print head 4 when printing into F, a relationship among such forces is $F+T<W$ (expression 1).

For example, in the case that F=500 g, T=400 g and W-1200 g, when a print medium whose thickness is the predetermined thickness or over is fed, the carriage assembly 11 can easily move upward; further, the movement of the carriage assembly 11 is restricted by the reaction force of the impact force of the print head 4 in printing. In the present embodiment, the difference (300 g) between F+T (900 g) and W (1200 g) is the best value, and neither it impose unnecessary load on the print medium passing under the print head 4, nor it makes the print head 4 rise due to impact force of the print head 4. In the present embodiment, the reaction force F (500 g) of impact force of the print head 4 and the self weight W of the carriage 3 are fixed values. Therefore, in order to set the relationship of all forces into a best relationship meeting the relationship expression, the pulling force T is set to 400 g. Therefore, the carriage assembly 11 can easily move upward. Thus, it is possible to prevent from happening damage of the print medium P due to a contact between the print medium P and the guide block 12 of the paper guider 9.

Next is to explain operation of the embodiment 1.

As shown in FIG. 1, first of all, the print medium P is fed from left side of the figure along the direction of arrow A. In the case that the thickness of the print medium P is below the predetermined thickness (e.g. 0.08 mm), the print medium P passes through the position between the paper guider 9 and the platen 2, and print head 4 prints on the print position under the print head 4. After printed, the print medium is taken out by the paper feed rollers 7 and 8 along the direction of arrow A. At this time, the paper guider 9 is not raised by the print medium P.

In the case that the thickness of the print medium P is the predetermined thickness or over, when the print medium P is fed to a position under the paper guider 9, the print medium P contacts the guide block 12 of the paper guider 9, so that the paper guider 9 is raised upward. At this time, because the platen 2 has a shape of cylinder, no excessive load is added to the print medium P when passing. And moreover, because the load on the print medium P is adjusted as mentioned above, the carriage assembly 11 does not add excessive load on the print medium, and only raise upward the part exceeding the predetermined thickness.

When the print medium P passes through the clearance between the print head 4 and the platen 2, the print head 4 begins to print. After printed, the print medium is taken out along the direction of arrow A. The carriage shaft 10 is raised naturally by raising the carriage 3 upward. At this time, the carriage shaft gear 15 moves upward along the rack 21 (the direction of arrow B). Because the phase of the carriage shaft gear 15 arranged on both ends of the carriage shaft 10 is consistent with that of the rack 21 arranged on the left and right of the side frames 17, the carriage shaft 10 can rotate together with the carriage shaft gear 15, and meanwhile, the carriage shaft 10 moves upward (the direction of arrow B) while keeping in a parallel state to the platen 2.

The tension spring 22 pulls the carriage assembly 11 upward so that the load of the carriage assembly 11 becomes a fixed value. Through set the relationship of load on the print medium P into the expression 1 above mentioned, it is possible to automatically follow the change of thickness of the print medium P, that is, the thickness change of the print medium P during the process of continuous print of single paper or print of bankbook whose thicknesses are different so as to keep the clearance between the print head 4 and the platen 2 in a fixed value.

Moreover, in the case to print on the print medium P whose thickness is the predetermined thickness or over, because the carriage assembly 11 moves along the carriage shaft 10, though the guide block 12 of the paper guider 9 rubs the surface (print surface) of the print medium P while moving, because the guide block 12 is made from ceramic as material, the printed character is not transferred onto the guide block 12.

As stated above, according to the embodiment 1, when the print medium P whose thickness is a predetermined thickness or over is fed, because the carriage assembly 11 straightly moves upward, the front edge portion of the print head 4 does not incline to the print medium, and printed character does not deform. Therefore, it is possible to supply a printer with high quality and with good throughput. More particularly, a printer that can effectively print the print medium P with thickness changing a lot such as bankbook and etc. can be provided. And moreover, because costly parts such as motor, sensor or magnet and etc. are not adopted, a printer with low cost can be provided.

Next, embodiment 2 is explained.

Embodiment 2

Figure 9:
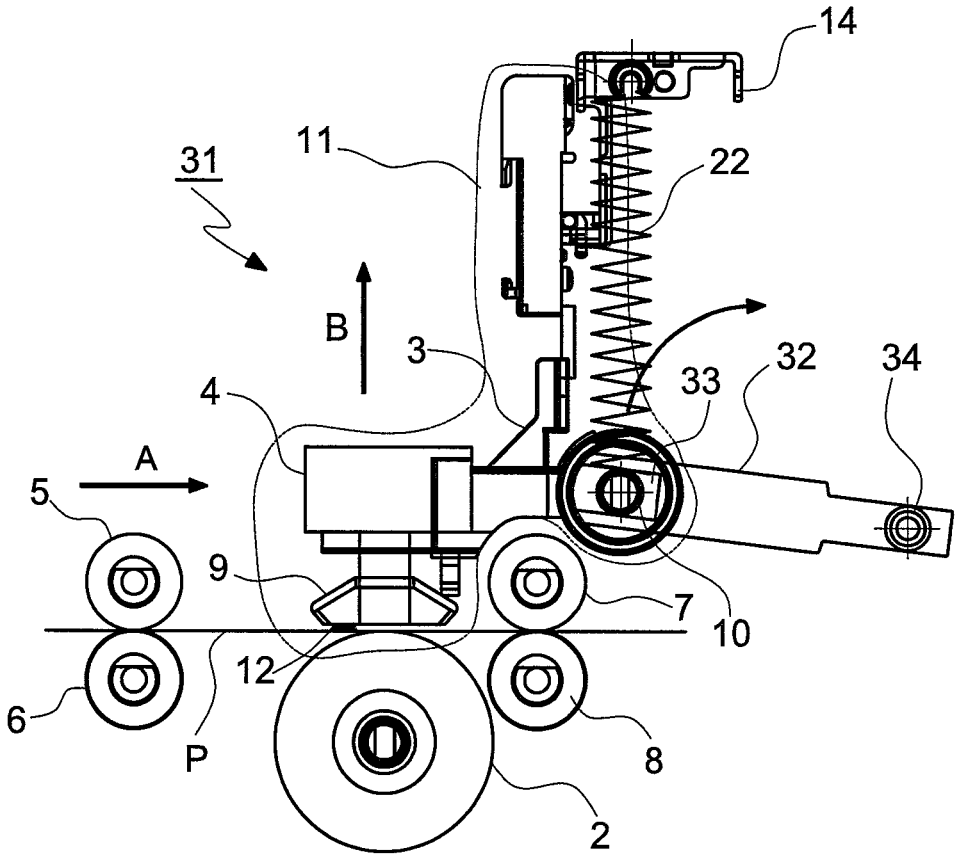
FIG. 9 is a side elevation showing main part of a printer in embodiment 2.

FIG. 9 is a side elevation showing main part of a printer in embodiment 2.

As shown in FIG. 9, in a printer 31 in the embodiment 2, the platen 2, the carriage 3, the print head 4, the paper feed rollers 5, 6, 7 and 8 and the paper guider 9 are the same with that in the embodiment 1. The carriage 3 is slidably fit to the carriage shaft 10.

As shown in FIG. 5 of the embodiment 1, the carriage shaft 10 can not move along the direction of arrow A, but only can move along the direction of arrow B. As stated in the embodiment 1, the tension springs 22 are respectively tied to the both ends of the carriage shaft 10. The tension springs 22 is used to adjust load of the carriage assembly 11 and to pull the carriage assembly 11 upward through a predetermined pulling force. Moreover, a relationship among the pulling force T of the tension spring 22, the load W on the print medium P due to self weight of the carriage 3 and the reaction force F of impact force of the print head 4 in printing is set to $F+T<W$ (expression 1).

Moreover, guide arms 32 are movably fit on both ends of the carriage shaft 10. One end of the guide arm 32 is formed from a U-shaped coupling portion 33. So that, the carriage shaft 10 is movably coupled with the U-shaped coupling portion 33. In the status, the carriage shaft 10 can move up and down. On other end of the guide arm 32, a guide shaft 34 is fixed through a bolt.

Figure 10:
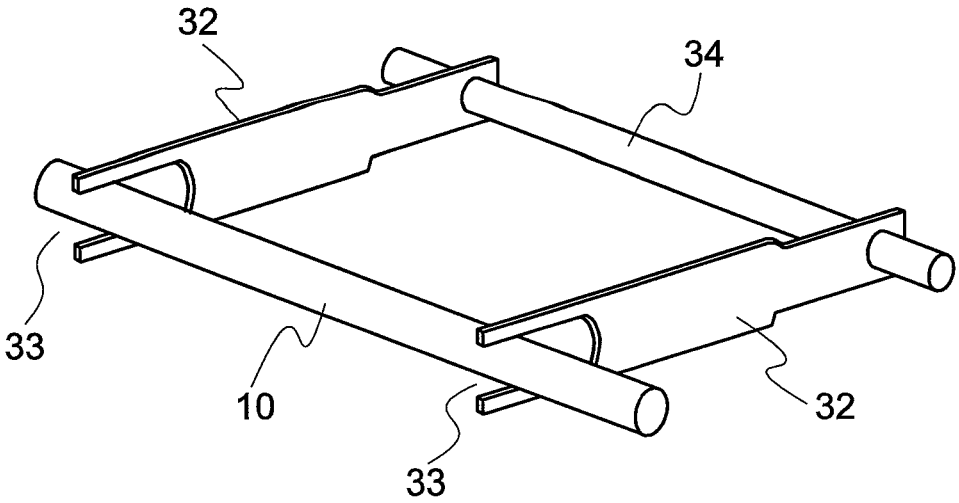
FIG. 10 is an oblique drawing showing a guide arm and a guide shaft.
Figure 11:
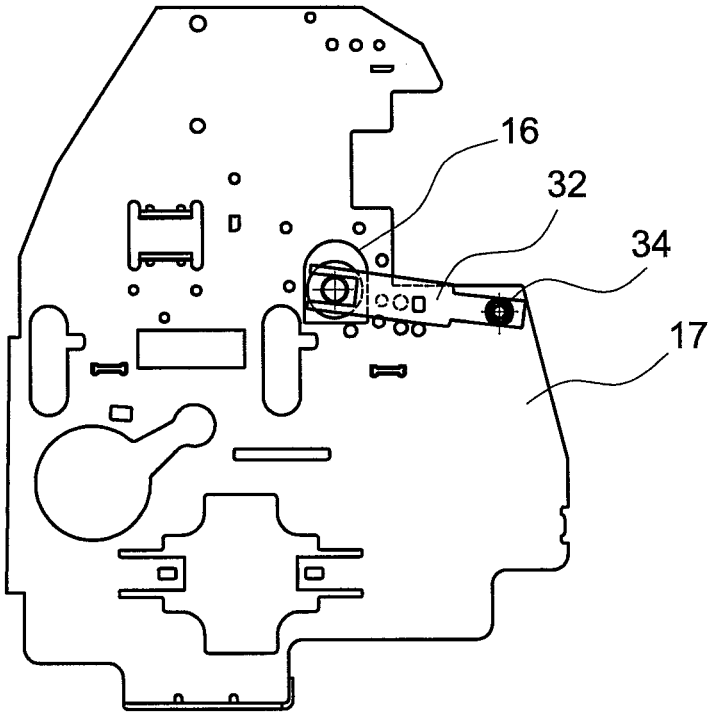
FIG. 11 is a side elevation showing a side frame in embodiment 2.

FIG. 10 is an oblique drawing showing a guide arm and a guide shaft; and FIG. 11 is a side elevation showing a side frame in embodiment 2.

As shown in FIG. 10, the guide shaft 34 and the carriage shaft 10 have almost the same length. Moreover, as shown in FIG. 11, the guide shaft 34 is rotatably supported by the side frame 17. The guide arms 32 is arranged on both ends of the carriage shaft 10, and the other ends of the guide arms 32 on both sides are respectively fixed on the guide shaft 34. Therefore, when one end of the carriage shaft 10 is raised, one end of the guide arm 32 on the raised side is also raised. At this time, other end of the guide arm 32 can also be raised through the guide shaft 34. Therefore, the carriage shaft 10 can be evenly raised. Regarding other components, they are the same as that in embodiment 1.

The following is to explain operation of the embodiment 2.

As shown in FIG. 9, like the embodiment 1, first of all, the print medium P is fed from left side of the figure along the direction of arrow A. In the case that the print medium P is thinner than the predetermined thickness (e.g. 0.08 mm), the print medium P passes through the position between the paper guider 9 and the platen 2, and print head 4 performs a print in the print position under the print head 4. After printed, the print medium is taken out by the paper feed rollers 7 and 8 along the direction of arrow A. At this time, the paper guider 9 is not raised by the print medium P.

In the case that the thickness of the print medium P is the predetermined thickness or over, after the print medium P is fed to a position under the paper guider 9, the print medium P contacts the guide block 12 of the paper guider 9. Similar to the embodiment 1, because the tension spring 22 pulls the carriage assembly 11 upward, so the carriage assembly 11 does not add excessive load on the print medium, but only raise upward the part of the print medium exceeding the predetermined thickness.

Figure 12:
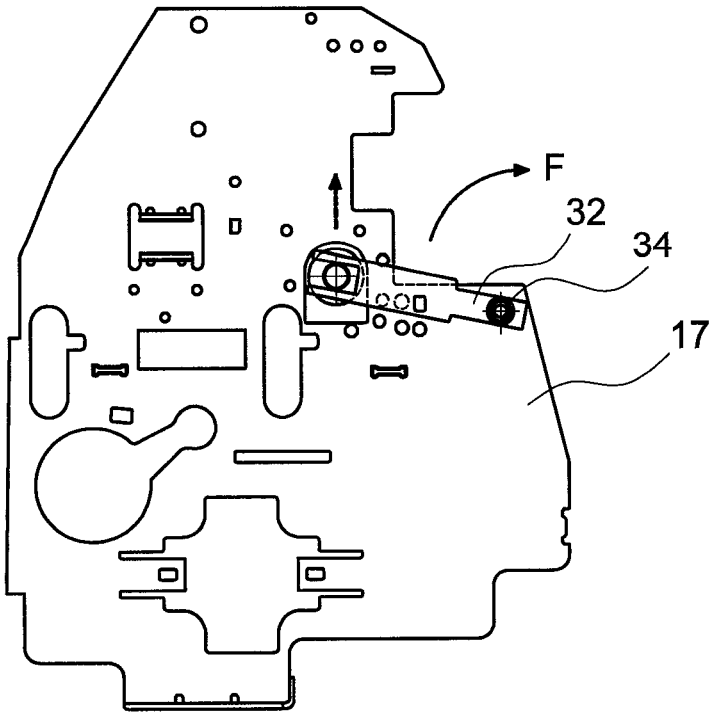
FIG. 12 is a side elevation showing operation of guide arm in embodiment 2.

FIG. 12 is a side elevation showing operation of guide arm in embodiment 2.

When the carriage shaft 10 moves upward (the direction of arrow B), because the U-shaped coupling portion 33 on one end of the guide arm 32 is movably fit on the carriage shaft 10, the U-shaped coupling portion 33 moves upward together with the carriage shaft 10. As shown in FIG. 12, the guide arm 32 rotates along the direction of arrow F around the guide shaft 34 as a center.

At this time, because the guide arms 32 on both sides is coupled with the guide shaft 34, for instance, when the guide arm 32 on one side is added load from the carriage shaft 10 and rotates around the guide shaft 34 as a center, the rotation is transmitted to the guide arm 32 on the other side through the guide shaft 34, and the guide arm 32 on the other side also rotates around the guide shaft 34. Because of the rotation of the guide arm 32 on the other side, end of the carriage shaft 10 placed on the side of the guide arm 32 of the other side moves upward with the same movement quantity as the opposite side. That is, as shown by a dashed arrow in FIG. 12, the carriage shaft 10 is always kept parallel to the platen 12 and moves upward.

When the print medium P passes through the clearance between the print head 4 and the platen 2, the print head 4 begins to print. After printed, the print medium is taken out along the direction of arrow A.

According to the embodiment 2, when the print medium P whose thickness is exceeding the predetermined thickness is fed, because the carriage assembly 11 straightly moves upward, the front edge portion of the print head 4 does not incline with respect to the print medium, and the printed character does not deform. Therefore, a printer with high quality and high throughput can be provided.

Moreover, when the print medium whose thickness is exceeding the predetermined thickness is fed, as a mechanism which enables the carriage shaft 10 to keep parallel to the platen 2 and move, because used a simple structure through combining the guide arm 32 and the guide shaft 34 in the embodiment, as compared with the embodiment 1, it is possible to further easily assemble the apparatus.

Next, embodiment 3 is explained.

Embodiment 3

Figure 13:
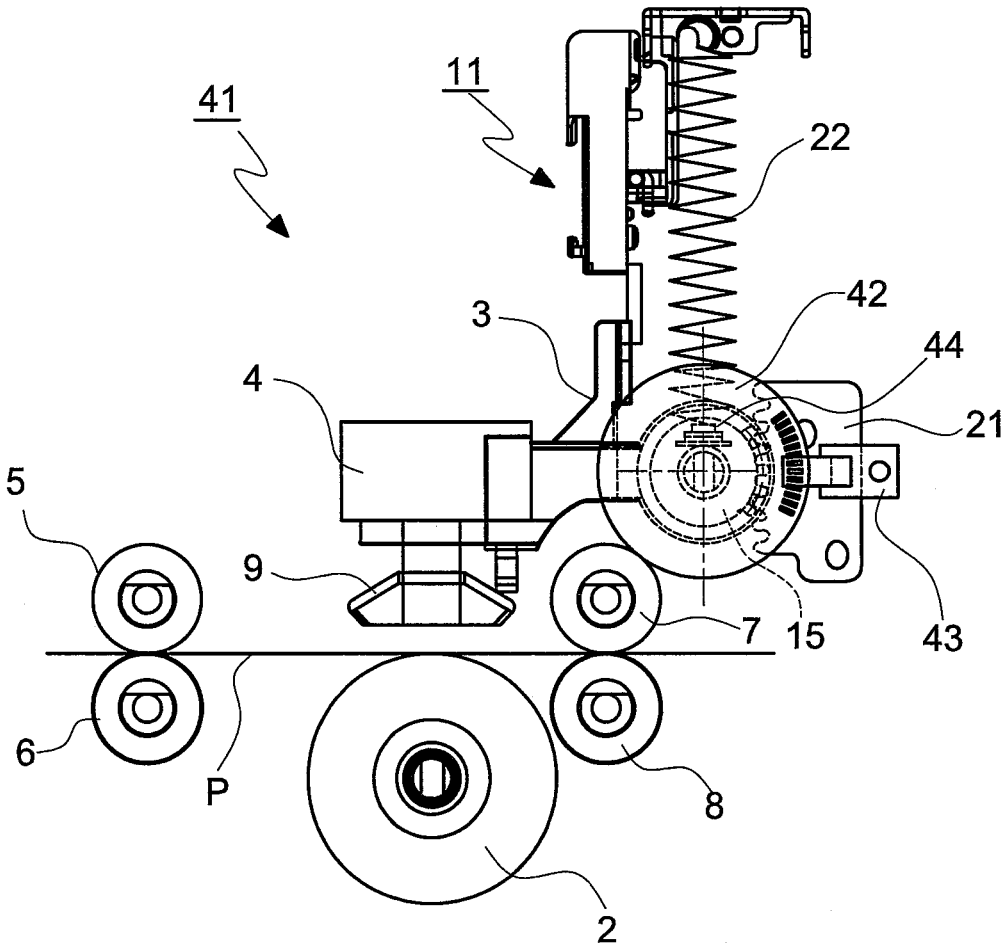
FIG. 13 is a side elevation showing main part of a printer in embodiment 3.

FIG. 13 is a side elevation showing main part of a printer in embodiment 3.

As shown in FIG. 13, in a printer 41 in the embodiment 3, the platen 2, the carriage 3, the print head 4, the paper feed rollers 5, 6, 7 and 8 and the paper guider 9 are the same with that in the embodiment 1. The carriage 3 is movably fit on the carriage shaft 10.

As shown in FIG. 5 of the embodiment 1, the carriage shaft 10 can not move along the direction of arrow A, but only can move along the direction of arrow B. As stated in the embodiment 1, the tension springs 22 are respectively tied to the both ends of the carriage shaft 10. The tension springs 22 is used to adjust load of the carriage assembly 11 and to pull the carriage assembly 11 upward through a predetermined pulling force. Moreover, a relationship among the pulling force T of the tension spring 22, the load W on the print medium P due to self weight of the carriage 3 and the reaction force F of impact force of the print head 4 in printing is set to $F+T<W$ (expression 1).

Moreover, like the embodiment 1, the carriage shaft gears 15 are respectively fixed on both ends of the carriage shaft 10. The carriage shaft gear 15 engages with the rack 21 arranged on the side frame 17. Because the phase of the carriage shaft gear 15 arranged on left and right of the carriage shaft 10 is consistent with that of the rack 21, the carriage shaft 10 can move upward in a parallel state with respect to the platen 2.

Moreover, a slit disk 42 is arranged on one end of the carriage shaft 10, and a slit sensor 43 used to nip the silt disk 42 is provided. The silt disk 42 is furnished on external side of the carriage shaft gear 15 and is fixed on the carriage shaft 10 by a bolt 44. The slit sensor 43 is positioned on external side of the rack 21 and is installed on a side frame not shown in the figure in a state parallel to the silt disk 42. Other components are the same as that in the embodiment 1.

Figure 14:
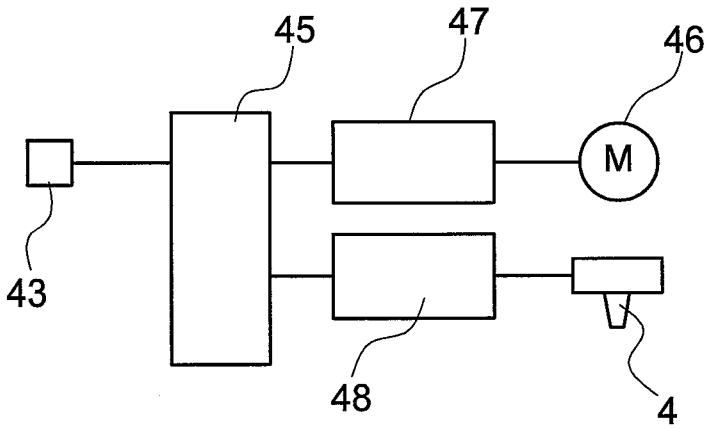
FIG. 14 is a control block diagram showing a printer in embodiment 3.

FIG. 14 is a control block diagram showing a printer in embodiment 3.

As shown in FIG. 14, a control section 45 is to control all operations of the printer 41 in the embodiment 3, and is connected with the slit sensor 43. The slit sensor 43 inputs a silt detection signal of the silt disk 42 into the control section 45. Moreover, the control section 45 is also connected with a spacing motor driver 47 to drive a spacing motor 46 and a head driver 48 to drive the print head 4. The spacing motor 46 is a motor that enables the carriage 3 to move towards a spacing direction.

The control section 45 reads a thickness of the print medium P from the silt detection signal inputted from the slit sensor 43. When the read thickness exceeds a predetermined similar thickness, the data is transmitted to the spacing motor 46 and the print head 4 through the spacing motor driver 47 and the head driver 48 so as to adjust print speed and impact force to suitable values corresponding to the thickness of the print medium P.

The following is to explain operation of the embodiment 3.

Figure 15:
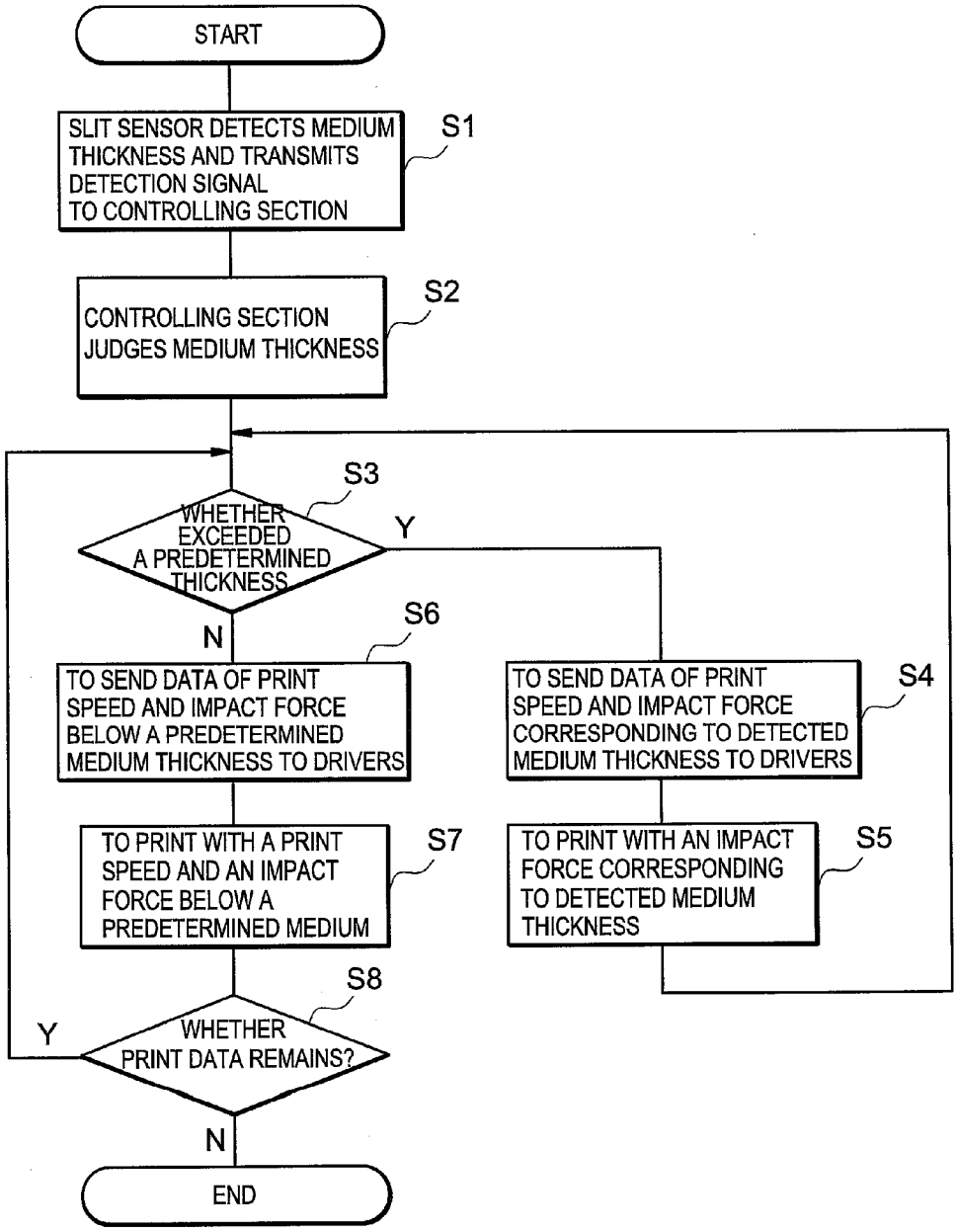
FIG. 15 is a flow chart showing operation of embodiment 3.

Regarding the operation that the carriage assembly 11 moves regarding upward when the print medium P whose thickness is exceeding the predetermined thickness is fed, because it is the same as the embodiment 1, so here, it is to explain the operations of the silt disk and the slit sensor according to a flow chart of FIG. 15.

FIG. 15 is a flow chart showing operation of embodiment 3.

In the case that the print medium P whose thickness is the predetermined thickness or over is fed, the carriage shaft 10 moves upward, the silt disk 42 also moves upward following the carriage shaft 10. At this time, the slit sensor 43 detects the number of silts passing through the slit sensor 43 through a movement of the silt disk 42, and transmits detection signal to the control section 45 (Step 1). The number of silts detected corresponds to the part exceeding the predetermined thickness in the thickness of the print medium P.

The control section 45, when received the detection signal transmitted from the slit sensor 43, judges the thickness of the print medium P from the predetermined similar thickness according to the detection signal (Step 2). Then, the control section 45 judges whether the obtained thickness of the print medium P exceeds the preset predetermined thickness (Step 3).

When the thickness of the print medium P is judged exceeding the predetermined thickness, the control section 45 respectively transmits data of print speed and impact force that correspond to the detected thickness to the spacing motor driver 47 and the head driver 48 (Step 4). Moreover, the spacing motor 46 enables the carriage 3 to perform spacing operation at a print speed corresponding to the detected thickness. Further, the print head 4 performs a print onto the print medium P with an impact force corresponding to the thickness of the paper (Step 5).

In Step 3, when the thickness of the print medium P is judged not exceeding the predetermined thickness, the control section 45 transmits data of print speed and impact force corresponding to the paper thickness below the preset predetermined thickness to the spacing motor driver 47 and the head driver 48 respectively (Step 6). Moreover, the spacing motor 46 makes the carriage 3 performs a spacing movement at a print speed corresponding to the paper thickness below predetermined thickness. And the print head 4 prints on the print medium P with an impact force corresponding to the paper thickness below predetermined thickness (Step 7).

When the above mentioned operations is repeated till print data is fulfilled (Step 8), the print operation is finished. The slit sensor 43 always detects the thickness of the print medium P, when the thickness changes (when the thickness is changed to exceed or not to exceed the predetermined thickness), at that time, the print speed and the impact force are control to change.

According to the embodiment 3, in addition to the effect in the embodiment 1, because the thickness of the print medium P is detected, and the print speed and the impact force used for printing change according to the detected thickness, so it is possible to supply a printer with higher quality and high throughput. In particular, it is effective when printing on a print medium with large change in paper thickness such as bankbook and etc.

The present invention is not limited to the foregoing embodiments, but a plurality of modifications and variations are possible. For instance, the silt disk 42 and the slit sensor 43 in the embodiment 3 can be provided to the printer in the embodiment 2. Moreover, in the embodiment 3, the detected paper thickness can be controlled not at two stages, but at more than three stages.

The utilization possibility in industry:

The above mentioned embodiments are explained taking the impact printer as an embodiment. The present invention can also be applied to other types of printer, such as ink jet printer, in particular to electrograph or copying apparatus and etc. besides printers.

What is claimed is:

1. An image recording apparatus for printing on a medium, the image recording apparatus comprising:

a print head adapted for printing on the medium;

a platen placed opposite the print head;

a guide block that protrudes toward the platen;

a carriage that carries the print head and the guide block;

a carriage shaft, the carriage mounted on the carriage shaft; and a guide portion having a lower part, the guide portion being formed larger than a diameter of the carriage shaft and extending in a substantially perpendicular direction with respect to a conveyance direction of the medium, the guide portion supporting the carriage shaft so that the carriage shaft can move in said substantially perpendicular direction relative to the conveyance direction, the carriage shaft being in contact with the lower part and the guide block spaced from the medium when the medium has a first thickness less than a predetermined thickness, wherein when the medium has a second thickness greater than the predetermined thickness, the guide block contacts the conveyed medium having the second thickness and moves in said substantially perpendicular direction relative to the conveyance direction together with the print head, the carriage and the carriage shaft under a guidance of the guide portion.

2. The image recording apparatus according to claim 1, further comprising:

an assisting portion for assisting the carriage shaft and the carriage to move towards the perpendicular direction.

3. The image recording apparatus according to claim 2, wherein the assisting portion is formed by an urging member which urges the carriage shaft to separate from the medium along the perpendicular direction.

4. The image recording apparatus according to claim 3, wherein one end of the urging member is connected with the carriage shaft, and other end of the urging member is connected with a post section installed on a frame forming the image recording apparatus.

5. The image recording apparatus according to claim 4, wherein the post section is held in a curved trench formed in a curved shape, in the conveyance direction of the medium, for performing a guide from the carriage shaft to the print head.

6. The image recording apparatus according to claim 5, wherein the print head is an impact head printing through entry and exit of a pin.

7. The image recording apparatus according to claim 6, wherein when a weight of the carriage is W, a pulling force of the urging member is T and a reaction force of the print head in printing is F, their relationship is $F+T<W$.

8. The image recording apparatus according to claim 4, further comprising:

a hole defined in the frame, the hole movably supporting the post section therein, the post section being fixable at any position within the hole.

9. The image recording apparatus according to claim 8, wherein the hole is comprised of a curved hole.

10. The image recording apparatus according to claim 4, wherein the urging member is comprised of a spring, movement of the carriage shaft adjusting tension in the spring and an inclination angle of the spring.

11. The image recording apparatus according to claim 4 further comprising:

a hole defined in the frame, the hole supporting the post section therein, the post section being movable within the hole to discretionarily set an inclination angle of the urging member, the urging member inclines to the print head.

12. The image recording apparatus according to claim 2, wherein the print head is comprised of an impact head, when a weight of the carriage is W, a pulling force of the assisting portion is T and a reaction force of the print head in printing is F, their relationship is $F+T<W$.

13. The image recording apparatus according to claim 1, wherein the guide portion maintains a clearance between the print head and a platen that is placed on an opposite side of the print head.

14. The image recording apparatus according to claim 1, further comprising:

an even moving portion that enables the carriage shaft to evenly move towards the perpendicular direction with respect to the conveyance direction of the medium.

15. The image recording apparatus according to claim 14, wherein the even moving portion is formed by a gear section that is respectively fixed on both ends of the carriage shaft, and by a rack section that is furnished on an apparatus frame and engages with the gear section.

16. The image recording apparatus according to claim 14, wherein the even moving portion is formed by guiding arms whose one ends respectively hold both ends of the carriage shaft movably, and by a guiding shaft fixed to respective other ends of the guiding arms.

17. The image recording apparatus according to claim 1, further comprising:

a movement quantity detecting portion that detects a movement quantity of the carriage shaft or the carriage towards the direction perpendicular to the conveyance direction; and a print controlling section that controls the print head, wherein the print control section changes control of the print head according to a detection result of the movement quantity detecting portion.

18. The image recording apparatus according to claim 1, wherein the guide portion includes a guide hole in which the carriage shaft is fit.

19. The image recording apparatus according to claim 18, wherein the guide hole is formed on a frame forming the image recording apparatus.

20. The image recording apparatus according to claim 1, wherein the guide block is placed between the print head and the platen.

21. The image recording apparatus of claim 1, further comprising:

a frame having first and second guide holes therein, the carriage shaft having first and second ends, the first and second ends movably mounted to the frame in the first and second guide holes, respectively, for movement in a direction generally perpendicular to the conveyance direction of the medium, the print head secured to the carriage shaft, the print head having a front edge; and a paper guider with the guide block extending therefrom in a direction generally perpendicular to the conveyance direction, the guide block having a guide block thickness, the paper guider secured to the print head such that the front edge is spaced from the medium at least a clearance comprised of the guide block thickness and a distance between the front edge and the guide block.

* * * * *